United States Patent [19]

Livi

[11] Patent Number: 4,929,488

[45] Date of Patent: May 29, 1990

[54] PIECE OF FURNITURE MADE OF GLASS AND THE LIKE HAVING A RESTING PROFILE MEMBER OF RUBBER

[75] Inventor: Vittorio Livi, Pesaro, Italy

[73] Assignee: FIAM S.r.l., Tavullia, Italy

[21] Appl. No.: 225,851

[22] Filed: Jul. 29, 1988

[30] Foreign Application Priority Data

Jul. 30, 1987 [IT] Italy ..... 22136/87[U]

[51] Int. Cl.[5] ..... B32B 3/00

[52] U.S. Cl. ..... 428/192; 428/441; 428/461; 428/465; 428/492; 428/494; 428/908.8; 49/462; 241/188.9; 241/345.1; 101/22

[58] Field of Search ..... 108/2.7; 248/188.9, 248/395.1; 428/192, 491, 461, 465, 492, 494, 908.8; 49/462

[56] References Cited

U.S. PATENT DOCUMENTS 1,849,570 3/1932 Duncan, Jr. ..... 248/188.9

4,666,762 5/1987 Yamamoto ..... 428/216

*Primary Examiner*—Patrick Ryan

[57] ABSTRACT

A piece of furniture made of glass, wherein the floor resting edge is provided with a resting profile member comprising a rubber strip, wherein a metal foil is embedded in the rubber strip and the composite structure is affixed to the edger of the floor resting edge by means of double tack adhesive tape; thus, the resting edge is protected against chipping or cracking.

2 Claims, 1 Drawing Sheet

PIECE OF FURNITURE MADE OF GLASS AND THE LIKE HAVING A RESTING PROFILE MEMBER OF RUBBER

DESCRIPTION

The present invention relates to a piece of furniture having at least one glass leg with a flat resting edge.

Glass (or lead glass) has long been used to make pieces of furniture. In recent years, improvements in glass working techniques enable pieces of furniture, and tables especially, to be formed integrally from glass, usually bent sheet glass. In this way, the merit of glass is enhanced by the very absence of any foreign material to interrupt its flowing glint.

Unfortunately, such tables have shown to be rather fragile when laid on hard floor surfaces (such as marble, ceramic tiles, and the like). In fact, direct contact with the floor coupled with slight movements cause the glass to chip or even break altogether.

It is an object of the present invention to provide a piece of furniture made of glass and the like, which has such constructional and functional characteristics as to overcome the drawbacks noted above.

This object is achieved, according to the present invention, by a piece of furniture as indicated, being characterized in that it comprises a rubber strip, a metal foil partly embedded in said strip, and an adhesive means between the metal foil and the resting edge for making the strip unitary with the leg.

The features and advantages of the piece of furniture according to the present invention will be apparent from the following detailed description of a preferred embodiment thereof, to be taken by way of illustration and not a limitation of the present invention.

BRIEF DESCRIPTION OF DRAWINGS

The present invention will become more fully understood from the detailed description given hereinbelow and the accompanying drawings which are given by way of illustration only, and thus, are not limitative of the present inventon, and wherein.

Figure 1:
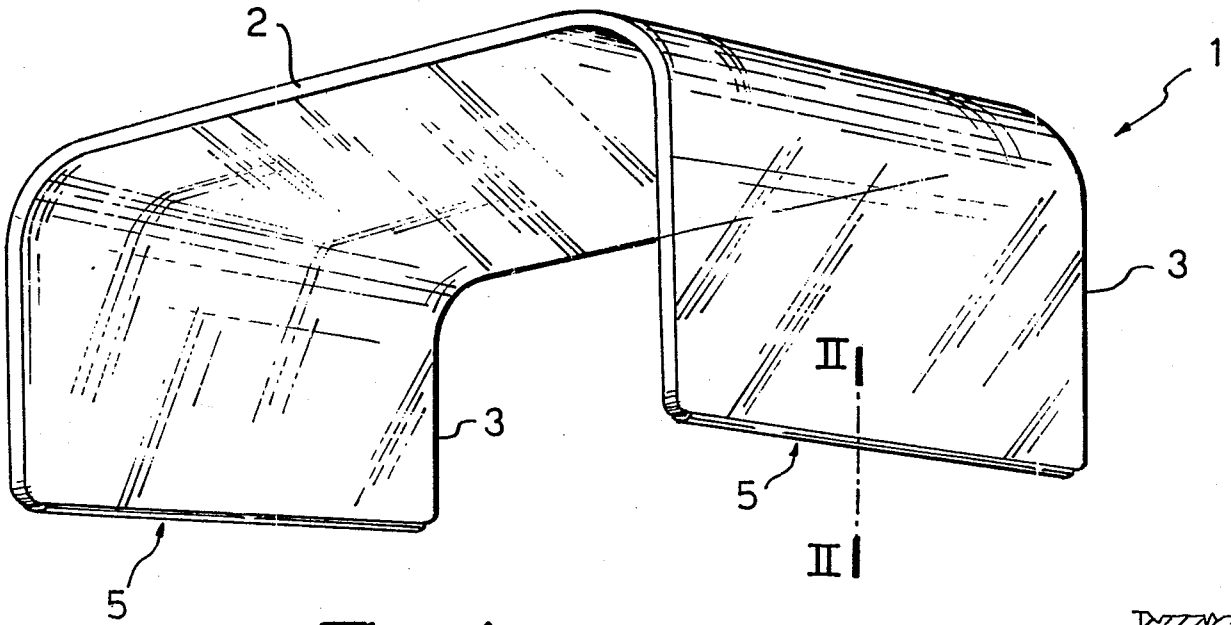
FIG. 1 is a perspective view of a piece of furniture according to the present invention.
Figure 2:
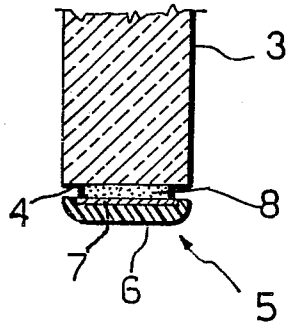
FIG. 2 is a sectional detail view of the piece of furniture shown in FIG. 1.

With reference to the drawings; numeral 1 generally designates a piece of furniture, specifically a coffee table, of a type which comprises a table top 2 and two legs 3, obtained by bending a single glass (or lead glass) sheet.

Defined downwardly on each leg 3 is a flat resting edge 4, which is provided with respective resting profile members 5 positioned to be between the edge 4 and the floor.

The profile member 5 is composed of a rubber strip 6 whose dimensions substantially correspond to those of the resting edge 4 and wherein a metal foil 7, preferably made of aluminum or a like non-ferrous metal, is partially embedded and made unitary with the rubber strip such as by vulcanizing. Also provided is an adhesive means 8 consisting, in the example being considered, of a length of double tack adhesive tape disposed between the metal foil 7 and the glass resting edge 4, whereby the resting profile member 5 is firmly affixed to the leg 3.

As may be appreciated, a coffee table according to the present invention overcomes the prior art drawbacks. In fact, the resting profile member of rubber protects the glass edges against chipping or cracking, while bringing about no aesthetic disturbance and no alteration of the glass flowing glint.

Furthermore, the resting profile members described above are sensible, simple to manufacture, and easy to assemble to the glass resting edges.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An item of furniture comprising at least one glass leg having a flat resting edge, said flat resting edge being provided with a rubber strip having a metal foil embedded therein, said metal foil having a size equal to or smaller than that of the rubber strip, and an adhesive means attached to the metal foil and the resting edge for making the rubber strip unitary with the leg.

2. The item of furniture according to claim 1, wherein said adhesive means comprises a length of a double tack adhesive tape.

* * * * *